United States Patent [19]

French

[11] 4,025,237

[45] May 24, 1977

[54] LATCHING MAGNETIC LEVEL SENSOR

[76] Inventor: George F. French, 4009 Linden St., Oakland, Calif. 94608

[22] Filed: Oct. 22, 1975

[21] Appl. No.: 624,608

[52] U.S. Cl. ..... 417/131; 417/138; 417/147

[51] Int. Cl.[2] ..... F04F 1/06

[58] Field of Search ..... 417/126, 128, 129, 130, 417/131, 134, 138, 143, 145, 146, 147; 73/308, 309, 322.5; 251/65; 137/209, 412, 416

[56] References Cited

UNITED STATES PATENTS

| | | | |
|---|---|---|---|
| 2,231,158 | 2/1941 | Davis | 251/65 |
| 2,362,802 | 11/1944 | Ciabattari | 417/128 X |
| 2,449,054 | 9/1948 | Cantlin | 73/308 X |
| 3,082,698 | 3/1963 | Smith | 417/147 X |
| 3,285,183 | 11/1966 | Hembree et al. | 417/40 |
| 3,443,319 | 5/1969 | Dooley | 251/65 X |
| 3,576,413 | 4/1971 | Creager et al. | 200/84 C |
| 3,751,983 | 8/1973 | Rutkowski et al. | 417/145 X |

FOREIGN PATENTS OR APPLICATIONS

| | | | |
|---|---|---|---|
| 1,040,377 | 10/1958 | Germany | 251/65 |

*Primary Examiner*—William L. Freeh
*Assistant Examiner*—Edward Look
*Attorney, Agent, or Firm*—James R. Cypher

[57] ABSTRACT

A latching liquid-level sensor including a vertically mounted free-floating float member which carries a magnet. A second magnet or ferromagnetic member separated from the first magnet by a liquid- and gas-impervious barrier is selectively actuated by the first magnet. The second magnet or ferromagnetic member is connected to a control logic system which is isolated from the float member which may be hermetically contained in a highly corrosive or explosive environment.

3 Claims, 10 Drawing Figures

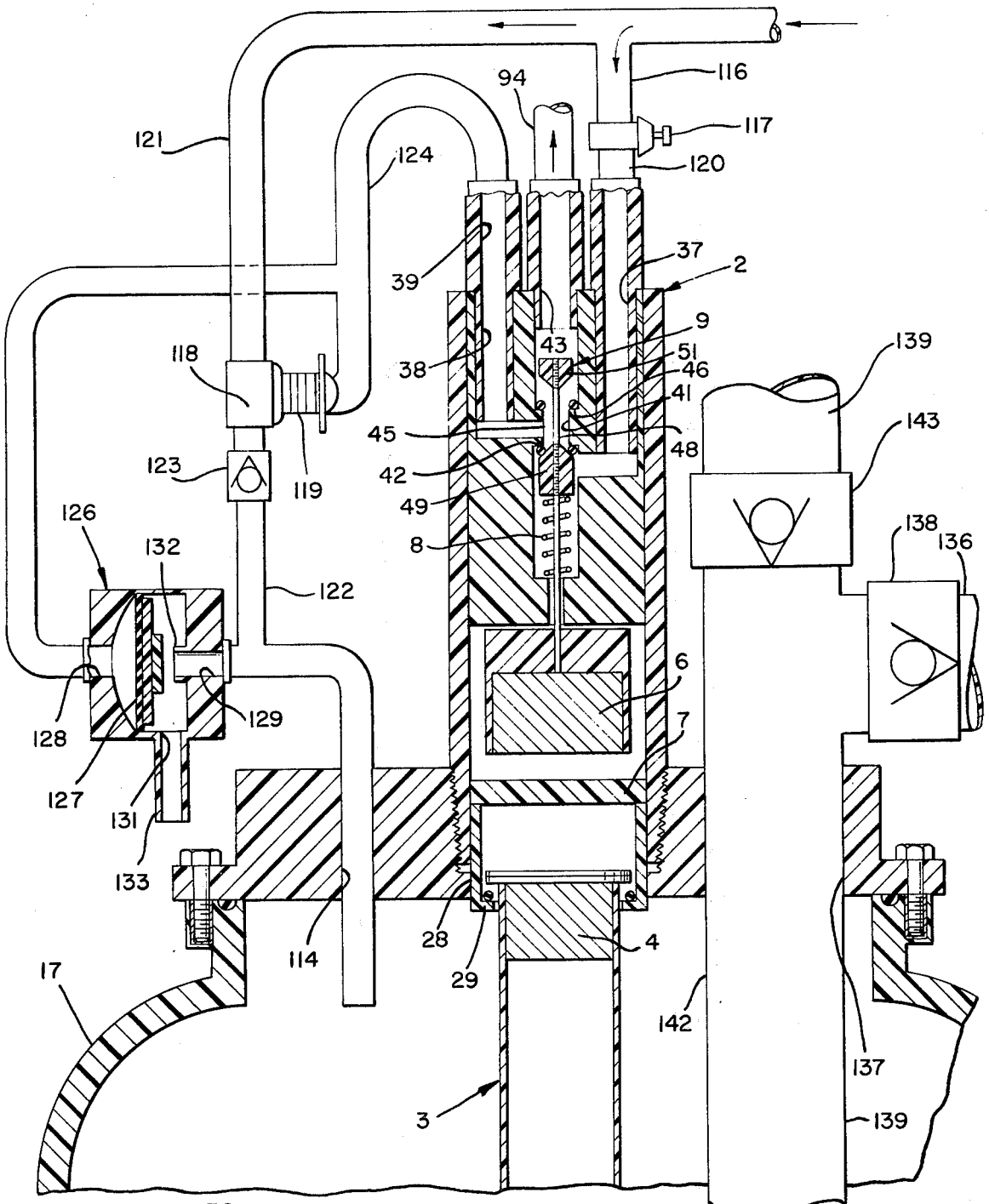
FIG. 6
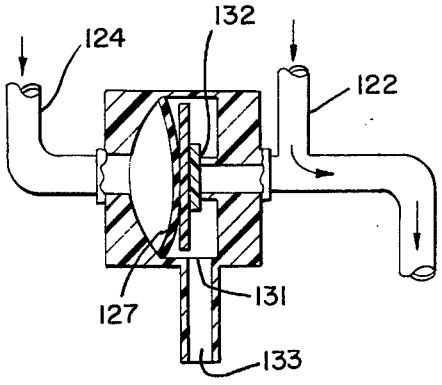
FIG. 7
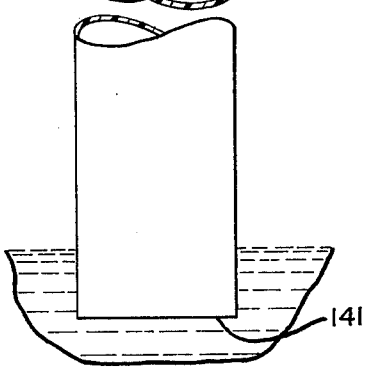

LATCHING MAGNETIC LEVEL SENSOR

BACKGROUND OF THE INVENTION

In dewatering pumping installations, the pumps are operated until the vessel or sump is empty or nearly empty and then they are turned off until the vessel or reservoir becomes full once more. In reservoir filling installations the converse is true. Such pump installations require level sensors to determine the maximum and minimum levels for activating and deactivating the pumps. Where the vessel or reservoir collects highly corrosive industrial wastes, raw sewage, or septic-tank effluent, mechanical and electrically operated level sensors become corroded or rendered inoperative by clogging from sticks, rags, abrasives, hair, etc. In some installations, the accumulating liquids may create gases which are highly inflammable and electrically operated sensors pose a danger of explosion or fire. Level sensors in such corrosive or sensor-clogging environments are often difficult to service and require frequent attention.

Pumps for handling sewage, sump, bilge and industrial waste waters and liquids are generally centrifugal units. Where the liquid is highly inflammable, or the material such as raw sewage contains a variety of solids — sticks, rags, rocks, hair, and other clogging material, pneumatic ejectors have frequently been preferred to electrically driven centrifugal pumps. Such pneumatic ejectors handle sewage, sludge, and industrial corrosive wastes in a number of installations, such as sewage lift stations, industrial-waste treatment plants, hotels and office buildings, where the basement is below the gravity sewer line. Pneumatic ejectors are also being increasingly considered for use in pressure-sewer systems where entire areas of a city pump sewage through pressure mains to the treatment plant.

Pneumatic ejector systems require hermetically sealed receivers and hood the raw sewage or corrosive effluent until a predetermined level in the receiver is reached. Compressed air is then automatically admitted to the receiver and the sewage or corrosive liquid is then discharged through check and sometimes gate valves to the pressure mains. Liquid-level sensors must be placed in the hermetically sealed receivers, and the signal transmitted to an electric motor, a diesel or gasoline engine which drives a pneumatic compressor. Electrical or metal mechanical sensors sealed within the container may be subject to extremely corrosive liquids and gases.

Electrodes or electrical contacts are soon grease-coated or fouled and require frequent servicing. Mechanical sensors, which are usually float-actuated, become corroded, or clogged by the materials frequently present in sewage or industrial wastes. Such conditions lead to system unreliability, access difficulty and prohibitive maintenance costs.

If the receiver is filled with flammable liquid or explosive gases, electrically operated liquid level sensors are either prohibited or extremely expensive because of the need to render them explosion proof.

SUMMARY OF THE INVENTION

The gist of the present invention is the use of a vertically mounted float which is virtually clog free, requires no external electrical connection, and is completely isolated from the logic portions of the sensor so that there is no corrosion, or clogging of the logic portion.

The float carries a magnet which magnetically couples with another magnet. The magnets are separated from one another by a liquid- and gas-impervious barrier. One of the magnets may be replaced by a ferromagnetic member. It is immaterial whether it is the first or second "magnet" that is replaced by a ferromagnetic member. Coupling of the magnets activates a valve means.

An object of the present invention is to provide a latching level sensor uniquely adapted for use in pneumatic-ejector systems which must pump highly corrosive liquids or where highly explosive gases are present.

A further object is to provide a level-sensor and pneumatic-ejector system which is easily installed and serviced in existing installations.

Still another object is to provide a system as described in which fluidic-logic controls facilitate alternate air valving from the input to the output side of the compressor, creating either vacuum or compression through the air-transfer tube so that the system can first suction-lift and then compression-discharge liquids, as in dewatering applications. Fluidic-logic elements similarly facilitate alternation between two ejector tanks so as to allow continuous pumping.

A still further object is to provide a system which can make use of one or more fluidic-relay elements to facilitate cascade control over high-volume or high-pressure liquid- or gas-flow applications.

Another object is to provide a level-sensor system wherein the uniquely vertical operating mode of the float member prevents fouling interference in such media as raw sewage, where stringy or other mixed materials have usually fouled other kinds of level sensors.

A further object is to provide a level-sensor system which is uniquely adapted for use with pressure-sewer systems because the sewate-ejection pressure is easily adjustable.

Another object is to provide a level-sensor system which is well suited for pressure-sewer systems because high ejection pressures can be used than with other systems.

Another object of importance particularly in rural areas is to provide a pumping system which will continue to operate automatically during electrical power outages without the expense of electrical standby generators and associated transfer switching means.

An additional object is to avoid the expense of running electrical power lines to the pump site.

Another object is to provide a system in which great economies can be effected in pressure sewer systems because a number of individual homes can be operated from a single compressor through underground air lines.

A further object of the present invention is to provide a system which can be used to accurately meter the liquid pumped.

BRIEF DESCRIPTION OF THE DRAWINGS

FIG. 6 is a cross section of another form of the invention in which the magnetic level sensor is used in combination with a piloted pneumatic ejector system and one type of quick-exhaust valve.

FIG. 7 is a view of the quick-exhaust valve shown in FIG. 6 in a different mode.

BRIEF DESCRIPTION OF THE PREFERRED EMBODIMENTS OF THE INVENTION

Figure 1:
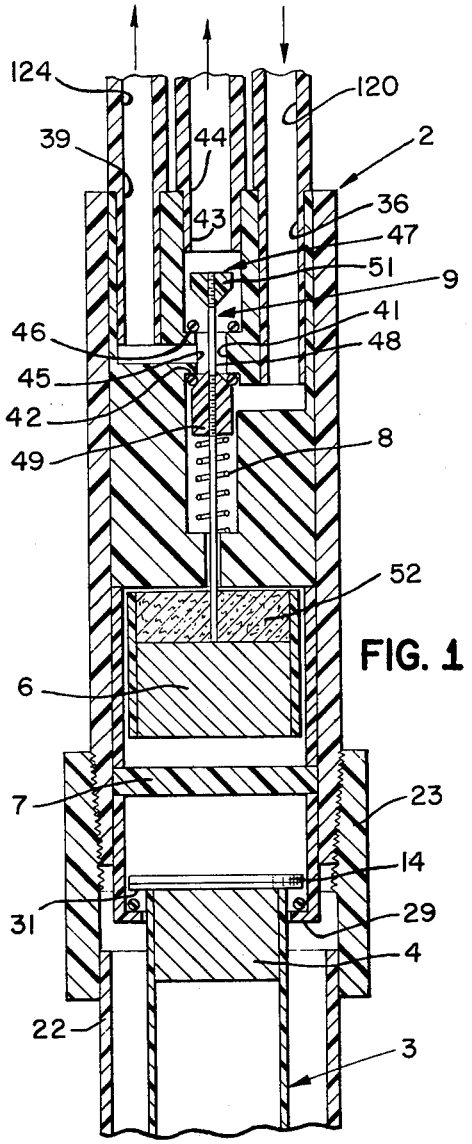
FIG. 1 is a cross-sectional view of the device of the present invention showing the float in its lower position.

The latching magnetic level sensor 2 of the present invention consists briefly of a sensor means 3 responsive to recurrent vertical elevational changes such as the change of liquid level in a container; a first magnet 4, connected to the sensor means, for reciprocating movement between first and second positions; a second magnet 6 spaced from the first magnet and mounted for reciprocation between a first position, in magnetic coupled relation to the first magnet, and a second positon in magnetic uncoupled relation to the first magnet; a barrier 7 separating the first and second magnets; biasing means 8 biasing the second magnet to the second uncoupled position; and valving means 9 operably connected to the second magnet. One of the magnets may be replaced by a ferromagnetic member and wherever the word "magnet" is used in this specification and claims, it is to be understood that only one permanent magnet is required. The other "magnet", may be replaced by an iron or other ferromagnetic member. The use of two permanent magnets of course provides greater holding power.

The sensor means 3 here consists of a liquid float member. The float is preferably made from a plastic material which will not deteriorate in these corrosive liquids and gases which corrode metals. One such plastic is polyvinyl chloride (PVC). The float is positioned to move vertically only and therefore the sidewalls should be vertical to prevent the accumulation of sediment or fouling by stringy and sticky material. A length of PVC tubing with a hollow interior 11 capped at its lower end by a plug 12 and partially filled with a weight 13 such as sand, makes an inexpensive yet excellent float. The amount of sand may be varied to provide the selected floatation for liquid materials of different specific gravity. The top end of the float carries the magnet 4 which is suitably attached to the innerwall of the float. An elastomer layer such as a urethane epoxy sold under the name Flexane typically covers the end of the PVC tubing so as to protect the ferrite magnet not only from corrosion but also from mechanical shock damage by the repeated striking of the top of the float against the barrier 7. Barrier 7 is preferably impervious to liquid and gas and may be constructed from PVC material.

Figure 2:
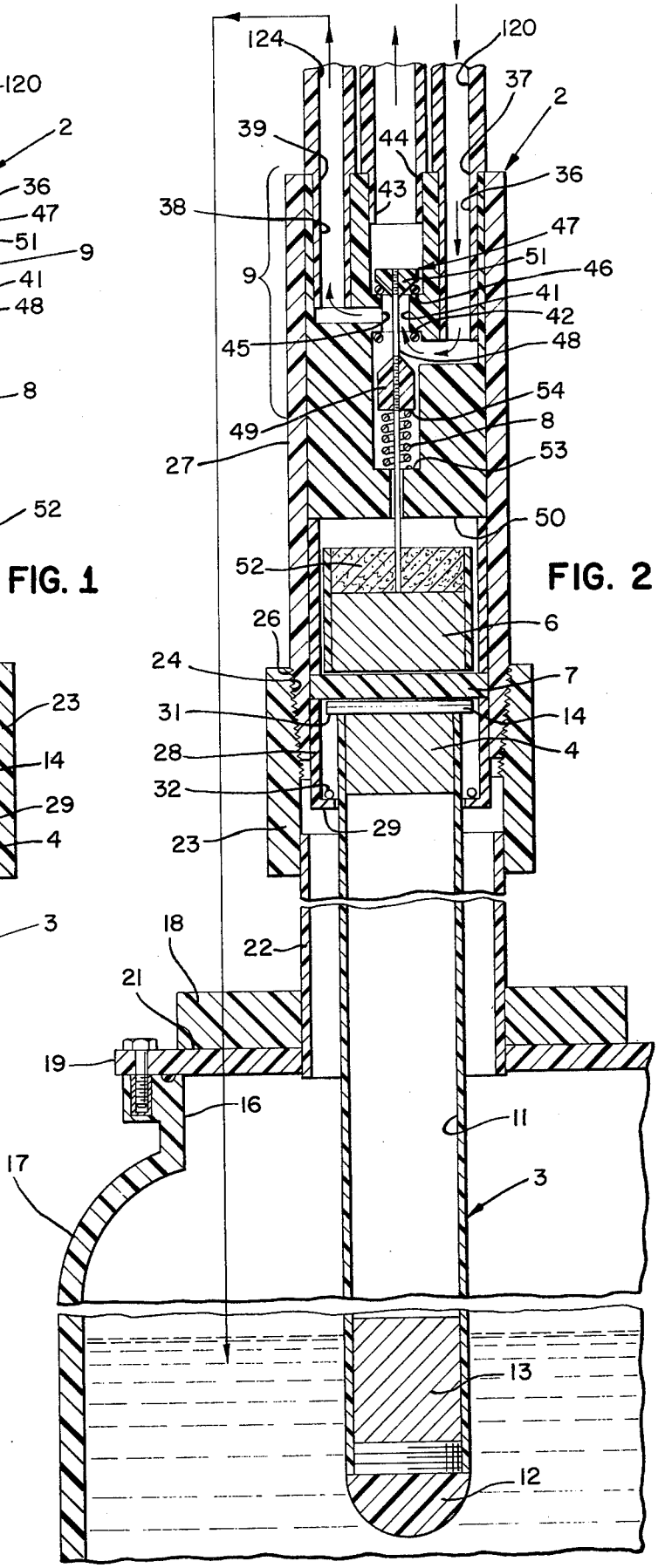
FIG. 2 is a cross-sectional view of the device of the present invention showing the float in its upper position.

One means for mounting the float 3 for vertical reciprocating movement is shown in FIG. 2. The top opening 16 in the container 17 covered with plastic block members 18 and 19 which are cement welded at face 21.

An elongated sleeve 22 is welded to the blocks 18 and 19 and a plastic collar 23 is welded at its lower end to the sleeve. The collar is formed with pipe threads 24 on its upper end which treadably mate with threaded end 26 of valve housing 27. Internal sleeve 28 welded to the valve housing is formed with an inwardly turned flange 29 which prevents the float from separating from the valve housing due to the shoulder 31 on the elastomer cover 14. An O ring 32 may be placed on flange 29 to cushion the shock of the descending float. The amount of float travel between flange 29 and the barrier 7 may be set to assure uncoupling of the magnets.

As shown in FIG. 2, the float 13 is mounted within the container and subject to the corrosive effects of the liquid being stored and pumped. Magnet 4 is sealed within the float from the corrosive atmosphere. The second magnet, biasing means and the entire switching means, on the other hand, are mounted outside and separated from its contents by barrier 7. The container is preferably made of a reinforced plastic. Thus the is absolutely no contact between the corrosive liquid and any metal.

The barrier thickness is selected so that when the magnets are in close proximity to the opposite faces of the barrier, they will be magnetically coupled. For some applications this thickness is about 3/16 inch. The strength of the magnets is such that when the magnets are coupled, the attraction of the magnets for one another will hold the weight of the float until the container is nearly emptied. When the liquid in the container rises, the float is brought near enough to the barrier to attract the second magnet to it. The float and magnets thus interrelate in a latching mode; a logic signal initiated at high liquid level will remain operant ("latched in") until low liquid level is again attained.

The action of the float and the magnets could be used to move an arm which could be coupled to an electrical switch or other type of signaling means. Since in a pneumatic ejector pump, however, air pressure is already available, it is preferable to use the compressed air as a switch or relay means. As shown in FIG. 2, one form of switch or valve is shown as an example. The valve means includes a valve housing 27 having a first air passage 36 therethrough with an air pressure inlet port 37 and a secong air passage 38 having an air pressure outlet (exhaust inlet) port 39 and a valve chamber 41 connected to the first and second air passages; a first valve seat 42 formed in the first air passage and the valve chamber; an exhaust passage 43 formed in the housing communicating with the valve chamber and having an exhaust port 44; a second valve seat 46 formed in the exhaust passage and the valve chamber; a spool valve 47 mounted for reciprocation in the housing between a first position and a second position and connected to the second magnet by a rod member 48 and having a first valve member 49 dimensioned for seating on the first valve seat when the spool valve is in the second position thereby providing communication between the outlet port and exhaust port and a second valve member 51 dimensioned for seating on the second valve seat when the spool valve is in the first position thereby providing communication between the air pressure inlet port and the outlet port.

As shown in FIG. 2, the spool valve 47 and the second magnet operate as a unit since they are connected by rod 48. The second magnet may be excased in a P.V.C. sleeve with the upper portion 52 filled with epoxy to secure the metal rod. The metal rod is attached to first and second valve members 49 and 51 by suitable cement welding means or by mechanically threading the rod and the valve members. The bias member is a type 316 stainless steel compression spring which is seated on shoulder 53 of the valve housing and biases against end 54 of the first valve member 49. The first and second valve members 49 and 51 are made of plastic such as "Delrin" a homopolymer acetal resin. The second magnet 6 or magnetic member moves within a chamber bounded by barrier 7 and upper wall 50.

One of the important features of the present liquid level sensor is the fact that the interrelationship of the two magnets and the buoyancy and weight properties of float 3 result in a "latching" effect. In other words, the magnets "latch" when the liquid level reaches a certain elevated point and the magnets do not uncouple until the liquid in the container reaches a much lower level.

Figure 3:
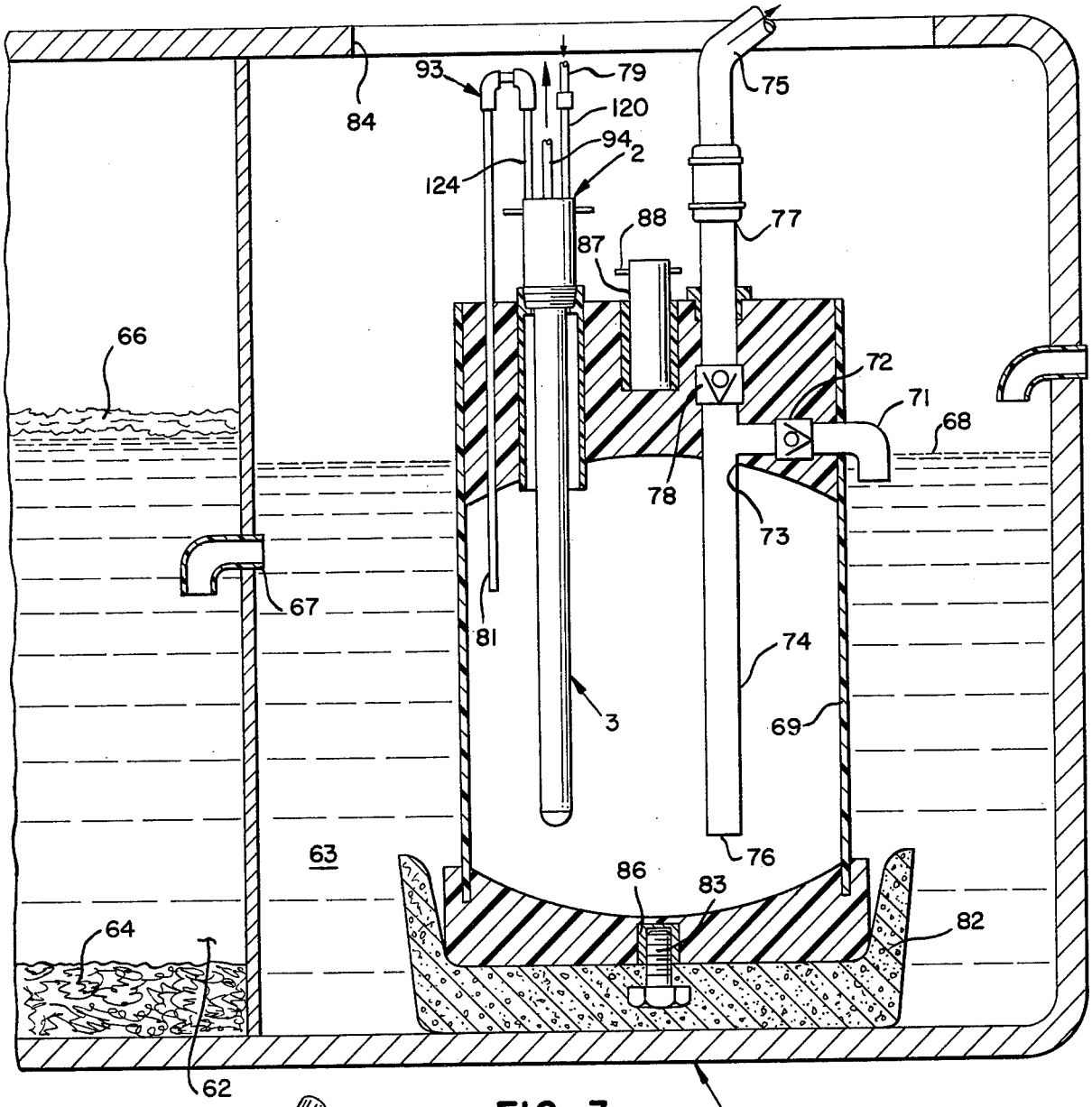
FIG. 3 is a cross section of the device of the present invention installed in a septic tank or interceptor tank.

The magnetic level sensor of the present invention may be used in pneumatic-ejector systems such as the system shown in FIG. 3 for intermittently pumping sewage effluent from any interceptor tank within a pressurized-sewer system or effluent from a septic tank to a leach field at a higher elevation than the septic tank.

The interceptor tank 61 is divided into a primary settling chamber 62 and a holding chamber 63. In the primary chamber a sludge layer 64 forms at the bottom and a scum layer 66 forms on the top of the liquid. An elbow fitting 67 transfers the relatively clear intermediate-layer liquid to the holding chamber. When effluent reaches level 68 it flows into container 69 through inlet conduit 71, past first check valve 72 and then through liquid material inlet port 73. As shown in FIG. 3 the inlet and outlet container port may have the same opening. A liquid material outlet conduit 74 is mounted in the container and has an inlet 76 positioned in the container at a preselected lower level of the liquid and an outlet end 77 connected to the outlet port of the container. A second check valve 78 is mounted vertically in the outlet conduit permitting flow of liquid out of the container only. Compressed air for the pneumatic ejector means enters a valve housing as shown in FIG. 2 through air inlet line 79, after passing through the switch means as previously described and then enters the container through air line 81.

Figure 4:
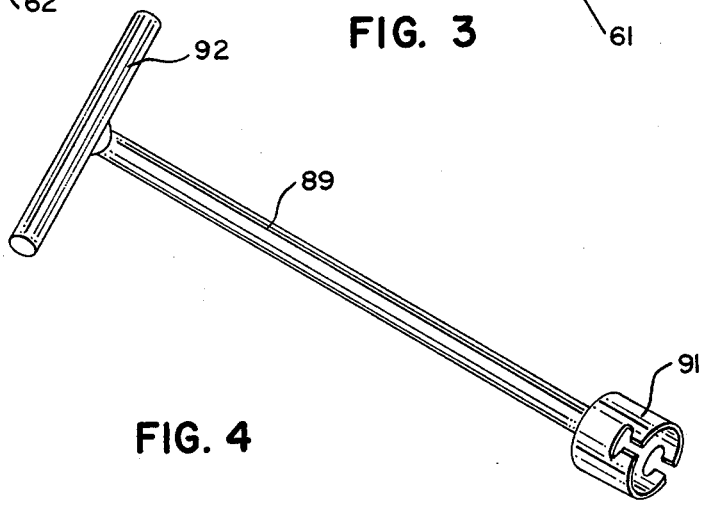
FIG. 4 is a perspective view of a tool used for installing or removing the modular system shown in FIG. 3.

A unique feature of the system shown in FIG. 3 is the fact that the entire system may be readily removed from the interceptor tank for servicing or replacement. A weighted member 82 having a threaded bolt 83 extending upwardly is placed in the holding chamber through opening 84. Next, the container 69 having an internally threaded insert 86 is lowered into the tank so that it is aligned with bolt 83. A stud 87 with a pin 88 mounted on the top of the container is turned by means of tool 89 shown in FIG. 4 hving a pin receiving end 91. Turning of the handle 92 of the tool turns the entire container and threadably attaches the container to the weight 82. A modular liquid-level sensor as shown in FIG. 2 and previously described is attached to the container. In order to facilitate removal of the unit from the interceptor tank, a disconnect coupling 93 is releasably attached to air lines 81 and 124. Air-exhaust line 94 may also be disconnected from exhaust port 44 by a suitable release coupling.

Figures 9, 10:
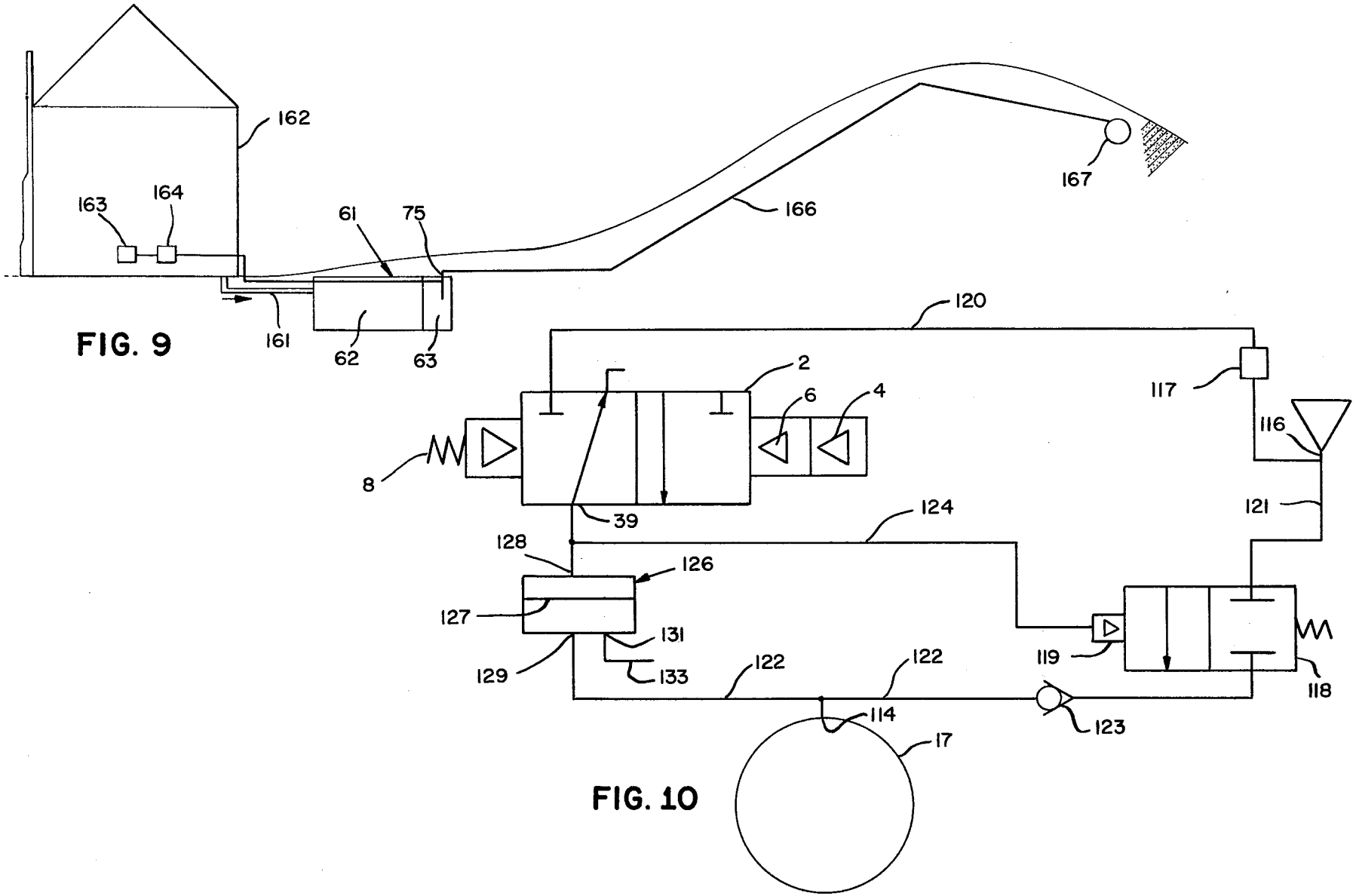
FIG. 9 is a schematic of a septic-tank effluent lift system using the magnetic level sensor of the present invention.
FIG. 10 is a schematic diagram of the system shown in FIG. 6.

Operation of a typical non-piloted system assuming the magnetic level sensor shown in FIG. 1 and 2, in a septic or interceptor tank as shown in FIG. 3, is as follows. Assume also that the installation is a typical home installation as illustrated in FIG. 9. Raw sewage from house 162 flows to the settling basin side of interceptor 62. Anaerobic digestion of solids occurs here as in all septic systems, and the clearer effluent flows through fitting 67 over into the holding chamber 63. During the fill cycle, air compressor 163 is off and adequate air pressure is maintained in the air receiver tank 164. Compressed air may be stored in the receivertank so that the system will continue to operate even during electrical power outages.

During the fill cycle period, the system will assume the attitude illustrated in FIG. 1. There is insufficient liquid in the tank to cause float 3 to rise and it will be supported on shoulders 31 by flange 29. The magnets will be uncoupled and spring 8 will force spool valve 9 upwardly so that valve member 49 seats on valve seat 42. Valve member 51, on the other hand will be lifted off valve seat 46. In this position, no compressed air from the line 120 will pass into the valve chamber. At the same time, the exhaust port 44 is in communication through opening 45 in valve chamber 41 with the atmosphere through line 94 and with line 81 to the tank 69 shown in FIG. 3. Venting the system to atmosphere permits effluent to enter tank 69 from holding chamber 63 through fitting 71, past check valve 72 and down pipe 74. As the liquid leve in tank 69 rises, a point is reached where float 3 approaches or reaches barrier 7. At this point, the attraction for magnet 6 by magnet 4 overcomes the force of spring 8 and rod 48 moves the first valve member 49 from seat 42 thereby permitting compressed air from the air receiver tank 164 to enter air inlet port 37 and to pass down air passage line 36, past valve seat 42, and into valve chamber 41. Since rod 48 also pulls down second valve member 51 in sealing engagement with valve seat 46 upon coupling of the magnets, the air pressure is diverted through opening 45, through passage 38, past outlet port 39 to air pressure line 124 and finally to line 81 where it enters the container 69. The air pressure, which may be about 35 psi, forces the liquid effluent downwardly through opening 76 and upwardly through pipe 74. The increase in pressure in pipe 74 closes check valve 72 thereby preventing the return of any effluent to the holding chamber 63; opens check valve 78 and effluent is forced out pipe 75 to force main 166. The attraction of the magnets is such that they remain coupled or latched while the effluent is being pumped out of container 69. When the container is nearly empty, the upward buoyancy on the float is diminished and its weight causes the magnets to uncouple. The system then assumes the attitude illustrated in FIG. 1 and the cycle is repeated. Excess pressure in the container 69 is exhausted to atmosphere through valve seat 46, exhaust passage 43 and exhaust line 94. Check valve 78 closes and check valve 72 opens; permitting the container to fill once again from holding chamber 63. The exhaust from the pressure tank may be piped to a leach field to facilitate effluent aeration or in a pressure system the exhaust may be vented to atmosphere through a roof vent. It has been found that septic-tank gases, such as hydrogen sulfide, may be effectively filtered by percolating the gases via small perforated pipe through subsoil filters consisting of crushed rock covered by a thin layer of soil.

Figure 5:
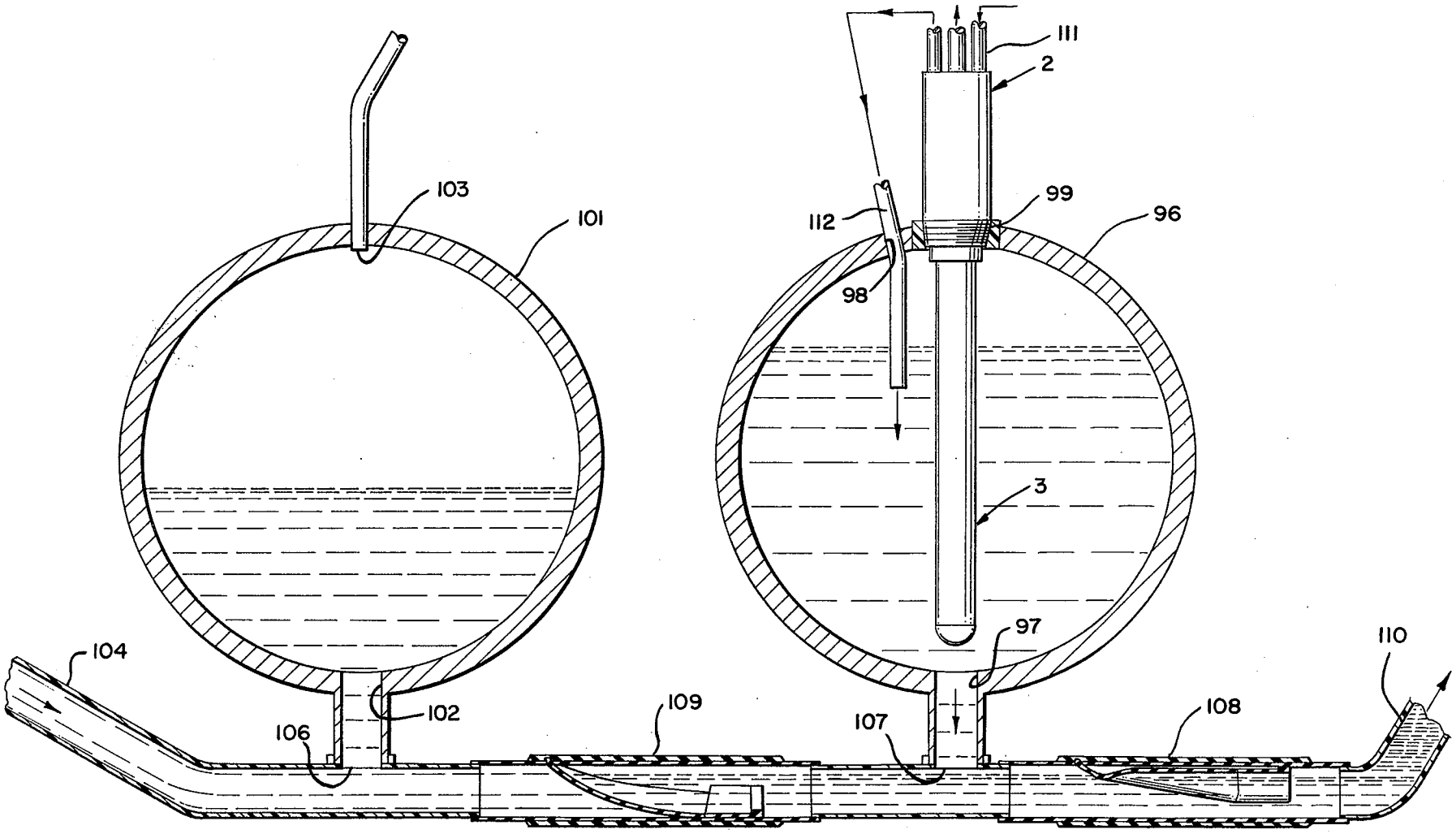
FIG. 5 is a cross section of a system using the magnetic level sensor of the present invention in a pneumatic-ejector system for pumping highly corrosive fluids and solids-laden liquids such as raw sewage.

The magnetic level sensor as previously described is uniquely suited to systems for pumping raw sewage such as the system shown in FIG. 5. The system here consists of a first sealed liquid material container 96 having a liquid material port 97, an air transfer port 98 and an opening 99 for receiving the magnetic level sensor device previously described. A second sealed liquid material container 101 has a material port 102 and a vent port 103. A liquid material conduit line 104 is connected to the first and second containers at openings 106 and 107. A first line check valve 108 in the material conduit line is located downstream of the first and second containers and permits material to pass in a downstream direction only. A second line check valve 109 in the material conduit is located upstream of the first container and downstream of the second container and also permits material to pass in a downstream direction only. Both check valves may be a standard check valve, but preferably they are the type described in my application Ser. No. 466,288 filed May 2, 1974 (Notice of Allowance dated Aug. 18, 1975.)

A compressed-air source (not shown) such as a standard air compressor supplies air under pressure through inlet line 111 to the magnetic level sensor 2 previously described and shown in FIG. 2. After passing through the switch means, the pressurized air enters the container through air pressure port 98 via air pressure line 112.

Operation of the raw-sewage pneumatic-ejector system is illustrated in FIG. 5. Raw sewage would normally require higher ejection pressures and therefore the piloted system shown in FIG. 6 would normally be used in conjuction with the system shown in FIG. 5. Outlet line 110 is under a head of pressure which causes first line check valve 108 to close. Air-pressure line 112 is normally vented to atmosphere through a quick-exhaust valve 126 as shown in FIG. 6 and thence to atmosphere through exhaust line 133. The pressure in vessel 96 is at or near atmosphere and sewage flowing through inlet line 105 bypasses vessel 101, moves through check valve 109 and enters the tank 96 through opening 107. As the vessel fills, float 3 remains in its lower position with the magnets uncoupled. As soon as preselected liquid level is attained, the float moves upwardly so that the magnets 6 and 4 of a piloted system as shown in FIG. 6 couple and relay high pressure air to the tank through air transfer port 98 and air line 112 as shown in FIG. 5. When pressure in container 96 exceeds the pressure in line 110, check valve 108 opens, check valve 109 closes as shown in FIG. 5 and the contents of the container 96 are ejected through line 110. During ejection or emptying of container 96, sewage being received through line 104 is diverted to container 101 where it accumulates. As soon as container 96 is nearly empty, the float 3 uncouples the magnets, compressed air is vented and the cycle is repeated with the closing of check valve 108 and the opening of check valve 109. In the system described, no air enters pipe 110, thereby eliminating entrained-air problems, thus contributing to the overall efficiency of the collection system.

The magnetic level sensor described above and shown in FIG. 2 may therefore also be used in a piloted or "relay" system in which low-pressure air, actuating the air operator 119 in FIG. 6, thus switches in high-pressure (or high-flow) air needed to operate the pneumatic ejector. This system is extremely useful where the liquid material must be pumped at high head pressures. Further, in pressure-sewer systems, individual interceptor sources feeding a common header at different elevations will be required to use different pumping pressures. The present system is uniquely capable of solving this problem.

Referring to FIG. 6, the magnetic level sensor device is the same as the device previously described and shown in FIG. 2. The piloted pneumatic ejector system consists briefly of a liquid float member 3 having a bottom and vertical sidewalls mounted for vertical reciprocation, an air-and liqid-impervious container 17 for receiving the float member therein and formed with a liquid material port 137 and a high air-pressure port 114 formed in an upper portion of the cover for the container or the container itself. High-pressure supply means (not shown) such as an air compressor sends compressed air through a first air pressure line 116 connected to the air pressure inlet port 37 of the valve housing 27. A pressure regulator 117 in the first air pressure line reduces the pressure of the high air-pressure means before it enters line 120. A normally-closed high-pressure two-way air-operated valve 118 (having a low-pressure operator 119) of standard design is connected to and controls the flow from a second high-pressure air line 121 and to a third high air-pressure line 122 which is connected to the high air-pressure port 114 of the container. A check valve 123 in the third high air-pressure line permits air pressure flow into the container only and prevents backflow of gases from container 17. A second low-pressure air line 125 is connected to the valve-housing outlet port 39 and to the low-pressure air operator 119 of the high-pressure two-way valve. A quick-exhaust valve 126 having a low-pressure air-actuated diaphragm 127, is connected to low-pressure line 124 by a low-pressure port 128. Valve 126 also has a high-pressure port 129 that is operatively connected to the upper portion of the container by line 122. A high-pressure exhaust port 131 communicates with high pressure line 122 and exhaust line 133 when diaphragm 127 is raised off valve seat 132 as shown in FIG. 6.

FIG. 7 illustrates the attitude of diaphragm element 127 when a low-pressure signal has reached the valve 126 via line 124 before a high-pressure air signal arrives at port 129 of the valve.

The piloted system above described may be used in any of the pneumatic-ejector systems previously described. FIG. 6 shows a typical installation which consists briefly of a liquid-material inlet conduit 136 connected to a liqud-material inlet-outlet port 137; a first liquid-material check valve 138 which permits flow into the container only and prevents backflow to the source of the gravity flow; a liquid-material outlet conduit 139 mounted in the container and having a liquid-material inlet-outlet port 141 positioned in the container below a preselected lower level of the liquid material in the container and having a liquid-material outlet end 142 connected to the liquid material inlet-outlet port; and a second liquid-material check valve 143 mounted in the liquid-material outlet conduit permitting flow of liquid material out of the container only and preventing backflow of any liquid held in the discharge line.

The operation of a piloted system as shown in FIGS. 6 and 7 is as follows. FIG. 6 illustrates the attitude of the parts when the system is in the fill mode and ejector tank 17 is filling. The liquid level is at a low point and the float member 3 is at its lower position and retained by shoulders 29 of sleeve 28. Spring 8 holds the spool valve 47 as that valve member 49 is seated on valve seat 42 and compressed air is prevented from entering the valve chamber 41. There is no pressure in line 124, therefore normally-closed two-way valve 118 is closed and the high air pressure (about 100 psi) is prevented from passing into the ejector tank 17. Since there is no pressure in line 124, no air passes to quick-exhaust valve 126 so that diaphragm element 127 remains raised off valve seat 132. As liquid enters the ejector tank, air in the tank is displaced and vented to atmosphere through port 114, line 122, quick-exhaust valve port 129, exhaust port 131 and lline 133. Spring-closed air check valve 123 prevents any corrosive gases, such as $H_2S$ gases from the ejector tank, from reaching the air-receiver tank and compressor or the metallic two-way air valve 119.

When ejector tank 17 of FIG. 6 is filled to a preselected level, float 3 rises until magnet 4 is forced against barrier 7. The attraction of magnet 4 for magnet 6 overcomes the biasing force of spring 8 and the force exerted by the compressed air on the underside of valve member 49. Rod member 48, which is preferably made from Monel 400 or stainless steel, attached to magnet 6 now pulls valve members 49 and 51 downward simultaneously. High-pressure air is released to the ejector tank 17 quickly in the following manner. The downward movement of valve member 49 permits the passage of high-pressure air through regulator 117 which reduces the pressure to about 35 p.s.i. from supply-line pressure about 100 p.s.i. Low pressures air moves through the valve passage 41 and since the valve member 51 is now seated on valve seat 46, the air moves through opening 45, through passage 38, exits opening 39 and moves through line 124 to air pressure operator 119. Two-way valve 118 is opened by the low-pressure signal and high-pressure air moves through line 121, through the valve 118, through check valve 123 to line 122 and into the ejector tank 17. Since low-pressure air simultaneously moves to the low-pressure port 128 of quick-exhaust valve 126, diaphragm element 127 moves onto seat 132, and closes the exhaust valve to the high-pressure air moving through line 122. FIG. 7 depicts this closed position. Increasing pressure in the vessel closes check valve 138 so that effluent moves up pipe 139 and through outlet conduit 139.

When ejector tank 17 in FIG. 6 is emptied to a predetermined level, several operations take place nearly simultaneously. First, the weight of float 3 which is now unsupported overcomes the magnetic attraction of magnet 6 for magnet 4 and drops to the position shown in FIG. 6. Spring 8 then forces magnet 6 to move upward, and valve members 49 and 51 move to the position shown. Air from the air compressor is cut off by valve chamber 49, and simultaneously the compressed air in the valve chamber and line 124 is exhausted to atmosphere though exhaust passage 43. Loss of pressure in line 124 causes low-pressure air operator 119 to close valve 118 and simultaneously releases diaphragm valve 127 which permits high-pressure air in the ejector tank to exhaust through port 114, pipe 122, port 129 through port 131 and to atmosphere through pipe 133. Loss of pressure in the ejector tank causes check valve 143 to close, and then the pressure in the tank is lower than the pressure in line 136, check valve 138 opens and permits effluent to once again enter the tank.

Figure 8:
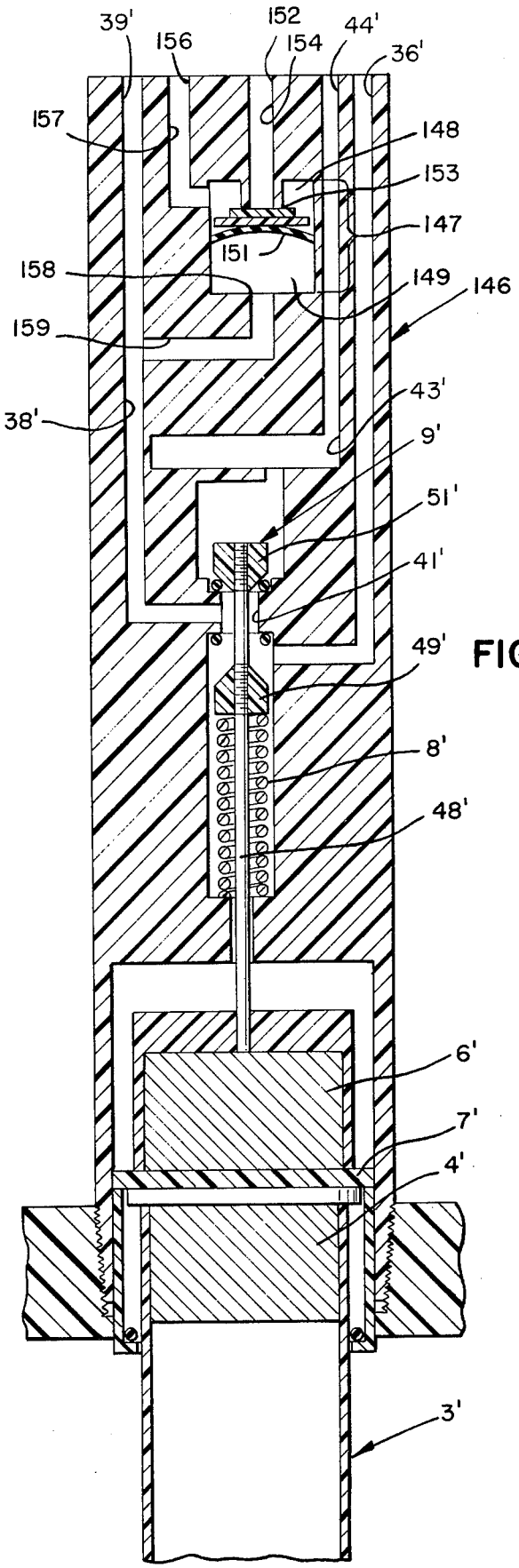
FIG. 8 is a cross-sectional view of another modified form of the invention in which the magnetic level sensor is shown in combination with a quick-exhaust valve with both combined in a single valve housing.

Some of the control elements of a pneumatic ejector system, including the magnetic level sensor, may be incorporated into a single valve housing 146 as shown in FIG. 8 instead of the separate-component system previously described. The switch of the piloted system is identical to the switch previously described and these elements of the pneumatic ejector system include a float 3', a first magnet 4', a barrier 7', a second magnet 6' connected by a rod 48' connected to a first member 49' and a second valve member 51'. A spring 8' biases the valve member from a first to a second position. The valve housing also includes a quick exhaust valve which includes high-low pressure chamber 147 divided into high and low pressure sections 148 and 149 by a movable diaphragm element 151. A high-pressure inlet port 152 communicates with valve seat 153 through passage 154. A high pressure exhaust port 156 communicates with the high pressure section of the high-low pressure chamber 147 through a passage 157. A low pressure port 158 is formed in the housing and communicates with the low pressure section 149 of the high-low pressure chamber. A third passage 159 communicates with the low-pressure port 158 and with the second low-pressure air passage 38'. The valve housing includes a first air passage 36', a second air passage 38' having an air pressure outlet port 39'. An exhaust passage 43' communicates with valve chamber 41' and exhaust port 44'.

FIG. 9 is a diagrammatic sketch of a pressure-sewer system showing a pneumatic pumping installation of the sort set forth in the present invention. Raw-sewage line 161 from house 162 flows by gravity to settling chamber side 62 of interceptor tank 61, thereby displacing effluent into holding chamber 63.

Pneumatic ejection as previously described can be powered either by an air compressor 163 with receiver tank 164, typically located in a homeowner's garage, or by a centralized larger compressor installation serving multiple pneumatic ejectors. Each individual ejector then pumps effluent either to a leach field or into a force main 166 connecting to a "common-header" pressure main 167. Effluent is thus pumped to a remote treatment plant.

Flow-rate metering, particularly of solids-laden, irregular-flow liqid materials such as raw sewage, is frequently important in order to determine required pipesizing, to help estimate waste-treatment plant capacities and to monitor sewage-system operations for either public- or private-sector requirements. This useful function may be accomplished by a simple adaptation of the present invention, described briefly as follows: The low-pressure air signal coming from the magnetic level sensor via line 124, as indicated in FIGS. 6 and 10, may also be sent to a standard normally-open pressure switch that closes an electrical circuit on rise of pressure. Connection may then be made from the signal output of such a pressure switch to the solid tripper coil of a standard electrical digital-readout counter. Recording the difference between successive counter-readings taken over a known period of time then provides date which in combination with the known volume of liquid displaced during on cycle of the ejection system, allows an operator to compute the total actual flow during such period of time. Use of this procedure will allow local authorities to inexpensively but accurately monitor the flow characteristics of sewerage systems, particularly with regard to proposed expansion of plumbing facilities. In some areas sewer-utility billing is dependent on total flow during a given period. At present there is no satisfactory method for measuring such flow rate, or total flow per unit time, of either raw sewage or indeed of other mixed, solids-laden or irregular-flow materials.

I claim:

1. A latching and automatic reset magnetic two-level liquid sensor providing a piloted pneumatic-ejector system comprising:

a. a housing including second magnet retaining means and sensor retaining means;

b. sensor means including a selected downwardly biasing means and a buoyancy means repetitively responsive to recurrent vertical elevation change between a first and a second preselected elevation;

c. force means generating said elevational changes and exerting a gradually increasing lifting force on said sensor means in a first mode and successively exerting a gradually decreasing lifting force in a second mode;

d. a first magnet connected to said sensor means for joint reciprocating movement between said first and second positions;

e. a second magnet or ferromagnetic member vertically spaced from said first magnet mounted for sliding reciprocation within said magnet retaining means between a first position in magnetic coupled relation to said first magnet and a second position in magnetic uncoupled relation to said first magnet;

f. a non-magnetic barrier mounted on said housing separating said first and second magnets;

g. spring biasing means biasing said second magnet to said second uncoupled position;

h. valving means connected to said second magnet responsive to said first and second preselected elevations;

i. said downwardly biasing means and said buoyancy of said sensor means being selected so that said first and second magnets remain in uncoupled relation during said first mode of said force means and in coupled relation during said second mode of said force means;

j. said valving means includes a valve housing having a first air passage therethrough with an air pressure inlet port and a second air passage having an air pressure outlet port, and a valve chamber connected to said first and second air passages;

k. a first valve seat formed in said first air passage and said valve chamber;

l. an exhaust passage formed in said housing communicating with said valve chamber and having an exhaust port;

m. a second valve seat formed in said exhaust passage and said valve chamber;

n. a valve mounted for reciprocation in said housing between a first position and a second position and connected to said second magnet by a rod member and having a first valve member dimensioned for seating on said first valve seat when said valve is in said second portion thereby providing communication between said outlet port and exhaust port and a second valve member dimensioned for seating on said second valve seat when said valve is in said first position thereby providing communication between said air pressure inlet port and said outlet port;

o. said sensor means consists of a liquid float member having a bottom and vertical sidewalls mounted for vertical reciprocation;

p. an air- and liquid-impervious container for receiving said float member therein and formed with a liquid material port and a high air pressure port formed in an upper portion of said container;

q. high air pressure means;

r. a first air pressure line connected to said air pressure inlet port of said valve housing and said air pressure means;

s. a pressure regulator in said first air pressure line for reducing the pressure of said high air pressure means;

t. a normally closed two way air valve having a low pressure air operator;

u. a second high pressure air line connected to said high air pressure means and to said two way air valve;

v. a third high air pressure line connected downstream of said two way air valve and connected to said high air pressure port of said container;

w. a check valve in said third high air pressure line permitting air pressure flow into said container only;

x. second low pressure air line connected to said valve housing outlet port and to said low pressure air operator of said two way valve; and y. a quick-exhaust valve having a low-pressure air-actuated diaphragm element, a low-pressure port, a high-pressure port operatively connected to the upper portion of said container and an exhaust port.

2. A latching and automatic-reset magnetic two-level liquid sensor in combination providing a piloted pneumatic ejector system comprising:

a. a housing including second magnet retaining means and sensor retaining means;

b. sensor means including a selected downwardly biasing means and a buoyancy means repetitively responsive to recurrent vertical elevation change between a first and a second preselected elevation;

c. force means generating said elevational changes and exerting a gradually increasing lifting force on said sensor means in a first mode and successively exerting a gradually decreasing lifting force in a second mode;

d. a first magnet connected to said sensor means for joint reciprocating movement between said first and second positions;

e. a second magnet or ferromagnetic member vertically spaced from said first magnet mounted for sliding reciprocation within said magnet retaining means between a first position in magnetic coupled relation to said first magnet and a second position in magnetic uncoupled relation to said first magnet;

f. a non-magnetic barrier mounted on said housing separating said first and second magnets;

g. spring biasing means biasing said second magnet to said second uncoupled position;

h. valving means connected to said second magnet responsive to said first and second preselected elevation;

i. said downwardly biasing means and said buoyancy of said sensor means being selected so that said first and second magnets remain in uncoupled relation during said first mode of said force means and in coupled relation during said second mode of said force means;

j. said valving means includes a valve housing having a first air passage therethrough with an air pressure inlet port and a second air passage having an air pressure outlet port, and a valve chamber connected to said first and second air passages;

k. a first valve seat formed in said first air passage and said valve chamber;

l. an exhaust passage formed in said housing communication with said valve chamber and having an exhaust port;

m. a second valve seat formed in said exhaust passage and said valve chamber;

n. a valve mounted for reciprocation in said housing between a first position and a second position and connected to said second magnet by a rod member and having a first valve member dimensioned for seating on said first valve seat when said valve is in said second position threby providing communication between said outlet port and exhaust port and a second valve member dimensioned for seating on said second valve seat when said valve is in said first position thereby providing communication between said air pressure inlet port and said outlet port;

o. said sensor means consists of a liquid float member having a bottom and vertical sidewalls mounted for vertical reciprocation;

p. an air and liquid impervious container for receiving said float member therein and formed with liquid material inlet-outlet port and an air transfer port formed in an upper portion of said container;

q. a liquid material inlet conduit connected to said liquid material inlet-outlet port;

r. a first liquid material check valve in said liquid material inlet conduit permitting flow into said container only;

s. a liquid material outlet conduit mounted in said container having a liquid material inlet positioned in said container at a preselected lower level of the liquid material in said container and having a liquid material outlet end connected to said liquid material inlet-outlet port;

t. a second liquid material check valve mounted in said liquid material outlet conduit permitting flow of liquid material out of said container only;

u. high air pressure means;

v. a first air pressure line connected to said air pressure inlet port of said valve housing and said air pressure means;

w. a pressure regulator in said first air pressure line for reducing the pressure of said high air pressure means;

x. a normally closed two way air valve having a low pressure air operator;

y. a second high pressure air line connected to said high air pressure means, and to said high pressure two way air valve;

z. a third high air pressure line connected downstream of said two way air valve and connected to said air transfer port of said container;

za. a check valve in said third high air pressure line permitting air pressure flow into said container only;

zb. a second low pressure air line connected to said valve housing outlet port and to said air operator of said high pressure two way valve; and zc. a quick exhaust valve having a low pressure air actuated diaphragm element, a low pressure port, a high pressure port and an exhaust port operatively connected to said air transfer of said container.

3. A latching and automatic-reset magnetic two-level liquid sensor comprising:

a. a housing including second magnet retaining means and sensor retaining means;

b. sensor means including a selected downwardly biasing means and a buoyancy means repetitively responsive to recurrent vertical elevation change between a first and a second preselected elevation;

c. force means generating said elevational changes and exerting a gradually increasing lifting force on said sensor means in a first mode and successively exerting a gradually decreasing lifting force in a second mode;

d. a first magnet connected to said sensor means for joint reciprocating movement between said first and second positions;

e. a second magnet or ferromagnetic member vertically spaced from said first magnet mounted for sliding reciprocating within said magnet retaining means between a first position in magnetic coupled relation to said first magnet and a second position in magnetic uncoupled relation to said first magnet;

f. a non-magnetic barrier mounted on said housing separating said first and second magnets;

g. spring biasing means biasing said second magnet to said second uncoupled position;

h. valving means connected to said second magnet responsive to said first and second preselected elevations;

i. said downwardly biasing means and said buoyancy of said sensor means being selected so that said first and second magnets remain in uncoupled relation during said first mode of said force means and in coupled relation during said second mode of said force means;

j. said valving means includes a valve housing having a first air passage therethrough with an air pressure inlet port and a second air passage having an air pressure outlet port, and a valve chamber connected to said first and second air passages;

k. a first valve seat formed in said first air passage and said valve chamber;

l. an exhaust passage formed in said housing communicating with said valve chamber and having an exhaust port;

m. a second valve seat formed in said exhaust passage and said valve chamber;

n. a valve mounted for reciprocation in said housing between a first position and a second position and connected to said second magnet by a rod member and having a first valve member dimensioned for seating on said first valve seat when said valve is in said second position thereby providing communication between said outlet port and exhaust port and a second valve member dimensioned for seating on said second valve seat when said valve is in said first position thereby providing communication between said air pressure inlet port and said outlet port; and o. said valve housing includes a differential pressure sensor including a high-low pressure chamber divided into high and low pressure sections by a reciprocating diaphragm member, a high pressure inlet port formed in said valve housing, a valve seat communicating with said high pressure inlet port and said high side of said high-low pressure chamber, a high pressure exhaust port communicating with the high pressure section of said high-low pressure chamber, a low pressure port formed in said housing communicating with the low pressure section of said high-low pressure chamber and a third passage communicating with said low pressure port in said high-low chamber and with said second low pressure air passage.

* * * * *